US006342859B1

(12) United States Patent
Kurz et al.

(10) Patent No.: US 6,342,859 B1
(45) Date of Patent: Jan. 29, 2002

(54) GROUND EXTENSION ARRANGEMENT FOR COUPLING TO GROUND MEANS IN AN ANTENNA SYSTEM, AND AN ANTENNA SYSTEM AND A MOBILE RADIO DEVICE HAVING SUCH GROUND ARRANGEMENT

(75) Inventors: Hans Peter Kurz, Solna (SE); Howard William Johnson, II, Primm Springs, TN (US)

(73) Assignee: Allgon AB, Taby (SE)

( * ) Notice: Subject to any disclaimer, the term of this patent is extended or adjusted under 35 U.S.C. 154(b) by 0 days.

(21) Appl. No.: 09/647,937

(22) PCT Filed: Apr. 20, 1999

(86) PCT No.: PCT/SE99/00636

§ 371 Date: Oct. 18, 2000

§ 102(e) Date: Oct. 18, 2000

(87) PCT Pub. No.: WO99/54956

PCT Pub. Date: Oct. 28, 1999

(30) Foreign Application Priority Data

Apr. 20, 1998 (SE) ..... 9801381

(51) Int. Cl.[7] ..... H01Q 1/24

(52) U.S. Cl. ..... 343/702; 343/700 MS; 343/895; 343/846

(58) Field of Search ..... 343/700 MS, 702, 343/846, 848, 895, 821, 829, 831

(56) References Cited

U.S. PATENT DOCUMENTS

| | | | | |
|---|---|---|---|---|
| 4,868,576 | A | 9/1989 | Johnson, Jr. | 343/702 |
| 5,014,346 | A | 5/1991 | Phillips et al. | 455/89 |
| 5,337,061 | A | 8/1994 | Pye et al. | 343/702 |
| 5,508,709 | A | 4/1996 | Krenz et al. | 343/702 |
| 5,542,106 | A | 7/1996 | Krenz et al. | 455/90 |
| 5,554,996 | A | 9/1996 | Chatzipetros | 343/702 |
| 5,561,436 | A | 10/1996 | Phillips | 343/702 |
| 5,561,437 | A | 10/1996 | Phillips et al. | 343/702 |
| 5,572,223 | A | 11/1996 | Phillips et al. | 343/702 |
| 5,649,306 | A | 7/1997 | Vannatta et al. | 455/575 |

FOREIGN PATENT DOCUMENTS

| | | |
|---|---|---|
| WO | WO97/23016 | 6/1997 |
| WO | WO97/26713 | 7/1997 |

*Primary Examiner*—Tan Ho

(57) ABSTRACT

Extendable ground arrangement for an antenna system in a radio communication device to be operating at within one or more frequency bands. The ground arrangement includes support means (1), e.g., a slide or flap, carrying conductive ground extension means (4). The support means has fastening means (5) for slidably or rotatably connecting the ground extension means to the radio communication device, wherein the ground extension means is adapted to radiate at at least said first frequency and to couple, e.g., capacitively, to main ground means located in the radio communication device adjacent to said first edge. When extended the extendable ground means provides improved gain and SAR reduction.

26 Claims, 11 Drawing Sheets

GROUND EXTENSION ARRANGEMENT FOR COUPLING TO GROUND MEANS IN AN ANTENNA SYSTEM, AND AN ANTENNA SYSTEM AND A MOBILE RADIO DEVICE HAVING SUCH GROUND ARRANGEMENT

FIELD OF THE INVENTION

The invention relates to a projective or extendable arrangement in a radio communication device such as a hand-portable telephone. The extendable arrangement forms part of an antenna system for the radio communication device. Such an extendable arrangement includes a movable and, preferably, non-conductive support means and conductive means supported by said support means. In particular, the support means may be a foldable or slidable cover portion of a hand-portable telephone.

RELATED PRIOR ART

There are general problems of providing, in modern mobile radio communication devices, such as hand-portable mobile telephones, an efficient antenna system that fulfills the demands of compactness, ease of portability and use, radiation distribution or directivity, operability in stand-by and talk (communication) modes, operability in plural communication systems, antenna spatial diversity, etc. The demands will vary depending on a selected radio communication system environment wherein the device is intended for operation. For instance, predetermined frequency bands, bandwidths, and system architecture or infrastructure set constraints and requirements to the performance of the antenna system.

In general, a mobile telephone includes a main housing holding an antenna as well as control and radio frequency circuitry. The main housing may also incorporate communication input means, e.g., a microphone or a key pad and communication output means, e.g., a loudspeaker or a graphics display. Of course, considering the many purposes one may include in a mobile radio communication device, the input and output means may handle various kinds of input and output quantities. In case the radio communication device is to be hand-held or located close to a part of the users body, there are problems of screening the radiation to and from the device and uncontrollable variations in the operation environment of the device affecting such parameters as, for instance, resonant frequency and impedance of antenna elements. It is also an unwanted effect that the radiation of the antenna system is absorbed in the body of the user. Problems of similar type may also occur if the radio communication device is operated directly from a communication terminal such as a stationary or portable computer.

There are further problems in designing an efficient antenna system to be mounted on or inside a radio communication device, especially when the device is relatively short in relation to a wavelength of a frequency band at which it is intended to operate. In fact, two common cellular telephone systems operate at approximately 800 and 900 Mhz, which gives wavelength of approximately 38 cm and 33 cm, respectively. It is common to aim at arranging the antenna system to include a dipole type antenna having a longitudinal extension of approximately half a wavelength. Frequently, part of the telephone housing or at least a conductive interior thereof constitutes a ground plane means of the antenna system. Longer antenna systems may also be advantageous. Physically shorter systems are achievable if at least some of the antenna elements are, e.g. folded or helical or meander-shaped, maintaining a desired electrical length.

If the radio communication device is to be hand-held, a suitable longitudinal extension of the device to be held is approximately equal to the distance across the hand, i.e., in the order of 10 cm. If the device should also perform the function of a telephone receiver, it should extend during use approximately between the ear and mouth of the user, i.e., optimally it should be slightly longer 10 cm.

These and other constraints and desires form the demands on a mobile radio communication device such as a mobile telephone. There have been many attempts in the prior art to provide efficient antennas meeting the demands. The result will always be a compromise optimized to meet a selected specification since a constant and ideal antenna environment is not achievable.

Below there will be briefly described two prior art antenna systems, which form part of the basis for the improvements obtained through the present invention. Even further prior art devices are indicated by references.

A first prior art antenna system for a portable cellular telephone is disclosed in U.S. Pat. No. 4,868,576 and includes a quarter-wavelength ground radiator and a helical coil capacitively coupled to an extendable half-wavelength radiator. The extendable radiator includes a tightly wound coil having a small diameter. The ground radiator includes a meander-shaped conductor extending perpendicularly from a feed point of the helical coil. The ground radiator and the helical radiator are connected via a feed transmission line to duplexer circuitry in the device. The antenna system disclosed therein is intended to improve the radio function of a small size portable radio and provide immunity to hand induced radiation losses.

A second prior art antenna system for a portable cellular telephone is disclosed in U.S. Pat. No. 5,554,996. That telephone includes a main housing and foldable flap to extend out from the main housing during a telephone call such that one end of the flap is hingedly connected to the main housing and the other end is to be located near the users mouth in talk position. For that reason the flap may advantageously include voice pickup means. The antenna system includes a first antenna having fixed and slidable parts at one end of the main housing and a second antenna at the other end of the housing where the flap is connected. The second antenna has two portions: one feed portion in the main housing and one parasitic radiator portion in the flap. The first and second antennas are intended to provide antenna diversity to the telephone. This means that the first and second antennas operate independently of each other and circuitry in the telephone selects a signal from the antenna providing the best signal at a given instant.

In the prior art there are several other hand-portable radio telephones which include a flip part covering the keypad when the telephone is not operated and for being moved away from the keypad when a user wishes to operate the keypad or answer an incoming call. Such arrangements are disclosed in patents and published patent applications such as U.S. Pat. No. 5,561,436 (Phillips), U.S. Pat. No. 5,337,061 (Pye), U.S. Pat. No. 5,561,437 (Phillips et al.), U.S. Pat. No. 5,014,346 (Phillips et al.), U.S. Pat. No. 5,649,306 (Vannatta et al.), U.S. Pat. No. 5,572,223 (Phillips et al.), U.S. Pat. No. 5,542,106 (Krenz et al.), U.S. Pat. No. 5,508,709 (Krenz et al.), WO 97/23016 (Geotech Communication, Inc.), and WO97/26713 (Ericsson, Inc.). There is also known from commercially available hand-portable radio telephones a slide part acting as a movable cover similarly to the flip parts referred to above.

Some of the telephones including flaps have a dual antenna diversity function, wherein one antenna is located in an upper portion of the telephone body and one in a flip part hinged at a lower portion of the telephone. Others have a main antenna element in or very closely coupled to the flip part fastened at a lower portion of the telephone. In the disclosed or known arrangements the antenna is coupled to circuitry (hot wire) of the telephone and part of the telephone main body is acting as a ground plane or ground means. It is a general problem to get a satisfactory antenna performance with hot wire antenna elements integrated in the flip part when folded together. This is increasingly difficult as dual and multiband operability, e.g. GSM in combination with PCN, is to be achieved.

However, in spite of all effort in the prior art towards providing diversity or main antenna elements in movable keypad covers, no disclosures or known devices account for the possibility or any means of arranging an improved ground means in the movable cover.

SUMMARY OF THE INVENTION

It is thus a main object of the invention to provide improvement in antenna performance in an antenna system having at least one extendable portion. The inventive improvement is particularly efficient in a device having a main housing including a ground portion, a fed antenna element at one end and an extendable portion at the other end. A particular object is to reduce adverse effects of currents being induced on a main body of a radio communication device in use. Another particular object is to provide a device that minimizes SAR. Yet another object is to provide operability in more than one frequency band.

These and further objects are attained by a system or device of the appended claims. The inventive extendability of the ground portion of a radio communication device enhances antenna performance. The invention provides the advantages of improving antenna performance parameters such as VSWR, antenna gain, limitation of SAR (Specific Absorption Rate), and immunity to screening as well as hand induced or other radiation losses. The dependent claims recite various enhancements of the invention in attaining above-mentioned objects. Several different types of ground structures may be employed alternatively in the invention, as will be evident from the detailed description below.

The extendable ground means is preferably coupled capacitively to ground means at a location having an elevated voltage. Thus, it should be noted that a voltage potential locally of a ground conductor in a radio device is not necessarily constant and equal to 0 volts in an RF signal sense. Rather, ground means in the context of this disclosure is a conductive portion coupled primarily to signal ground of radio transceiver circuitry. Generally, antenna feed circuitry is connected to the antenna, at an antenna feed point, by a hot connection and a ground or common connection. If required an impedance matching interface is arranged between the antenna and the feed circuitry.

There may advantageously be a balun means interconnecting to hot and ground elements in the inventive system.

In this disclosure it is to be understood that the antenna system of the invention is operable to transmit and/or receive radio signals. Even if a term is used herein that suggests one specific signal direction it is to be appreciated that such the situation covers that signal direction and/or, if applicable, its reverse.

BRIEF DESCRIPTION OF THE DRAWINGS

It should be noted that the drawings are not necessarily drawn to scale and proportions, but are intended to provide and facilitate understanding of the invention in order for a skilled person to apply the invention.

DESCRIPTION OF PREFERRED EMBODIMENTS

Figure 1:
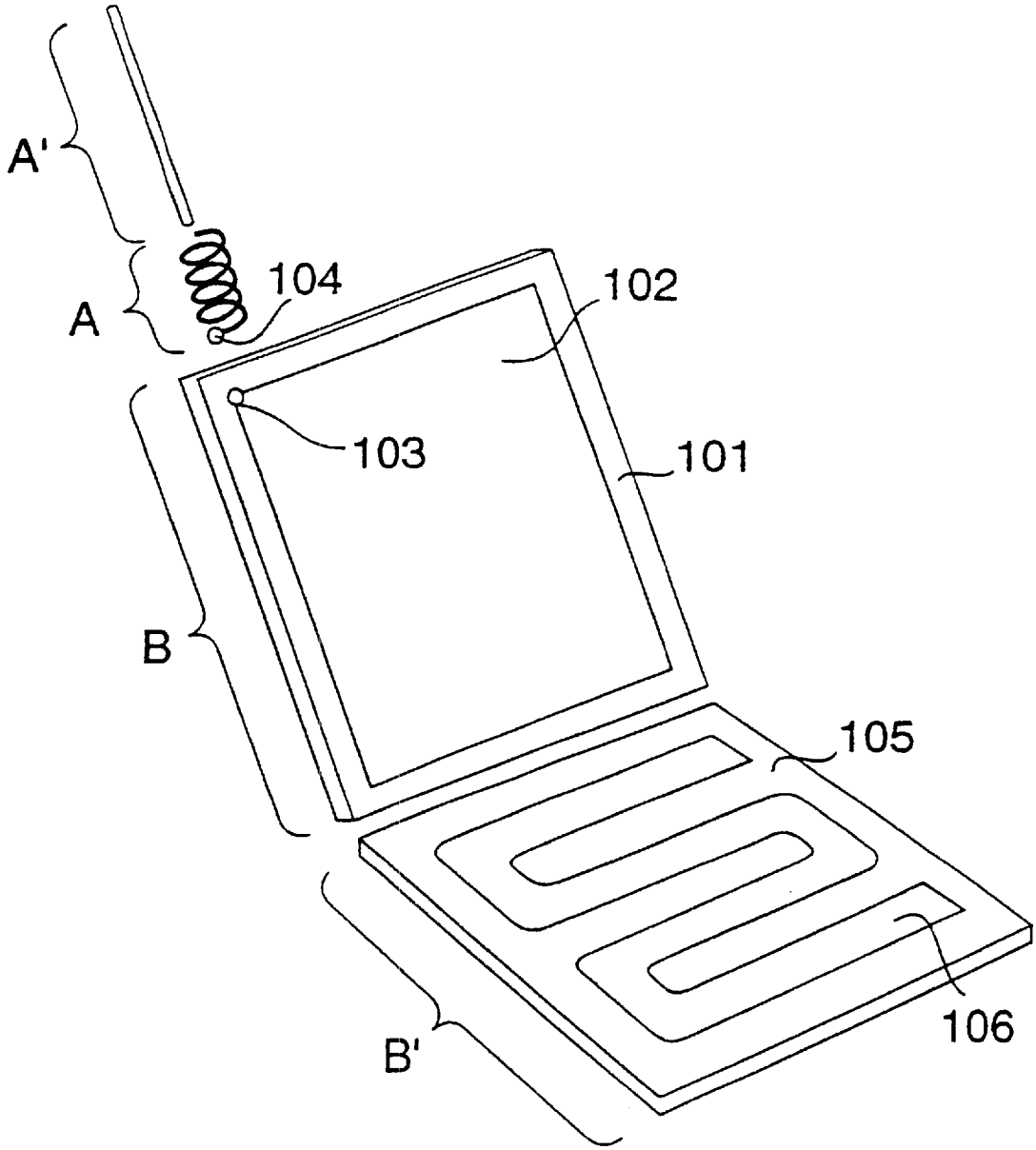
FIG. 1 illustrates principles of one embodiment of the invention wherein a printed circuit board, a helix, an extendable ground means, and an extendable antenna rod are included in an antenna system of a mobile telephone.

In the appended drawings, corresponding parts in different figures may have the same reference numerals when they have the same or a similar function.

In FIG. 1 there are shown schematically various different radiative components of an antenna system in a hand-portable radio telephone. First, there are four radiating elements in this embodiment, a helical antenna element A, a retractable rod antenna element A', a radiating main ground element B, and a ground extension element B'. The invention is not particularly concerned with the antenna elements A and A', which may alternatively have any suitable configuration for hot wire fed antennas, for example, only one helical element.

The ground elements, which are of particular importance in the invention include two portions, one printed circuit board 101 having a conductor pattern indicated for simplicity by a conductive patch 102, and one foldable extension portion including a support 105 having a conductor 106 thereon. The elements A and A' are fed by a hot wire via a feed point 104 by circuitry (not shown) included on the printed circuit board. The ground elements B and B' are fed by a ground wire via a ground point 103 also connected to said circuitry. The coupling between elements B and B' is capacitive in this example. However, it can be inductive or could even be conductive.

In the preferred embodiment of FIG. 1 the electrical lengths of the radiating elements A and B are approximately one quarter of a wavelength and the element B' has an approximate electrical length of half a wavelength. Element A' could preferably be half a wavelength. The ground extension element B' redistributes the radiation of the ground of the telephone and contributes to an improved radiation pattern and reductions in SAR.

Figure 2:
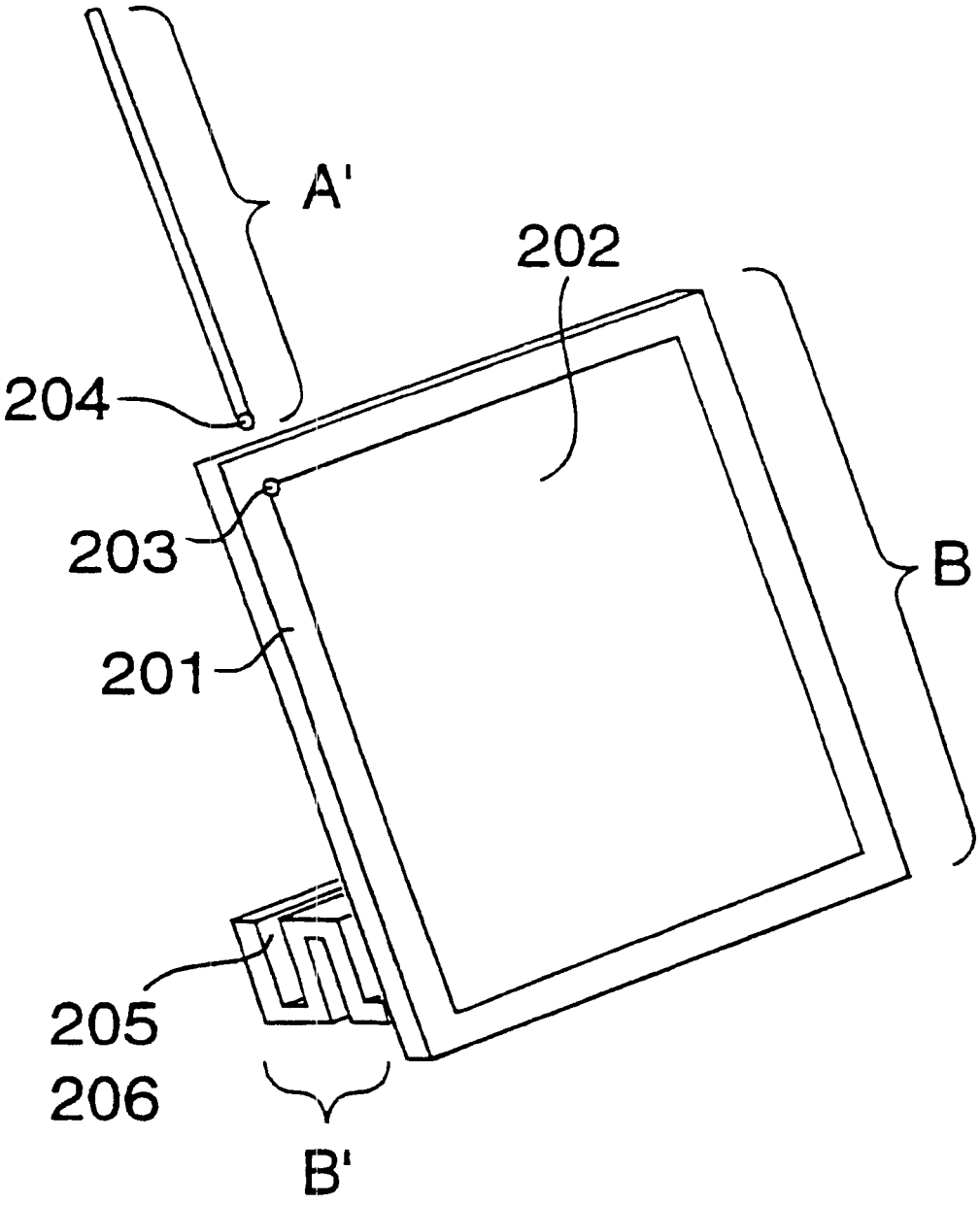
FIG. 2 illustrates principles of a second embodiment of the invention wherein a printed circuit board, a projective antenna and a projective ground means are included in an antenna system of a mobile telephone.

The embodiment of FIG. 2 is similar to that of FIG. 1 but includes, for the sake of example, only one hot antenna element A, and the ground elements B and B' there of are arranged essentially at a greater angle than those in FIG. 1.

The ground elements here too include two portions, one printed circuit board 201 having a conductor pattern indicated by a conductive patch 202, and one projecting extension portion including a support 205 constituting in itself a conductor 106. While the element A is fed by a hot wire via a feed point 204 by circuitry (not shown) included on the printed circuit board, the ground elements B and B' are fed by a ground wire via a ground point 103 also connected to said circuitry. The coupling between elements B and B' is conductive in this example. However, it could alternatively be non-conductive.

In this preferred embodiment, the electrical lengths of the radiating element A can be any suitable one, for example, ranging between one quarter and one half of a wavelength, preferably in an upper portion of said range. The elements B and B' together have an approximate electrical length of preferably more that one quarter of a wavelength. It is preferably selected to be any suitable electrical length in an upper portion of the range mentioned for element A or longer. An important feature of the ground extension elements B and B' is that they together redistribute the radiation of the ground of the telephone and contributes to an improved radiation pattern and reductions in SAR.

Figure 3:
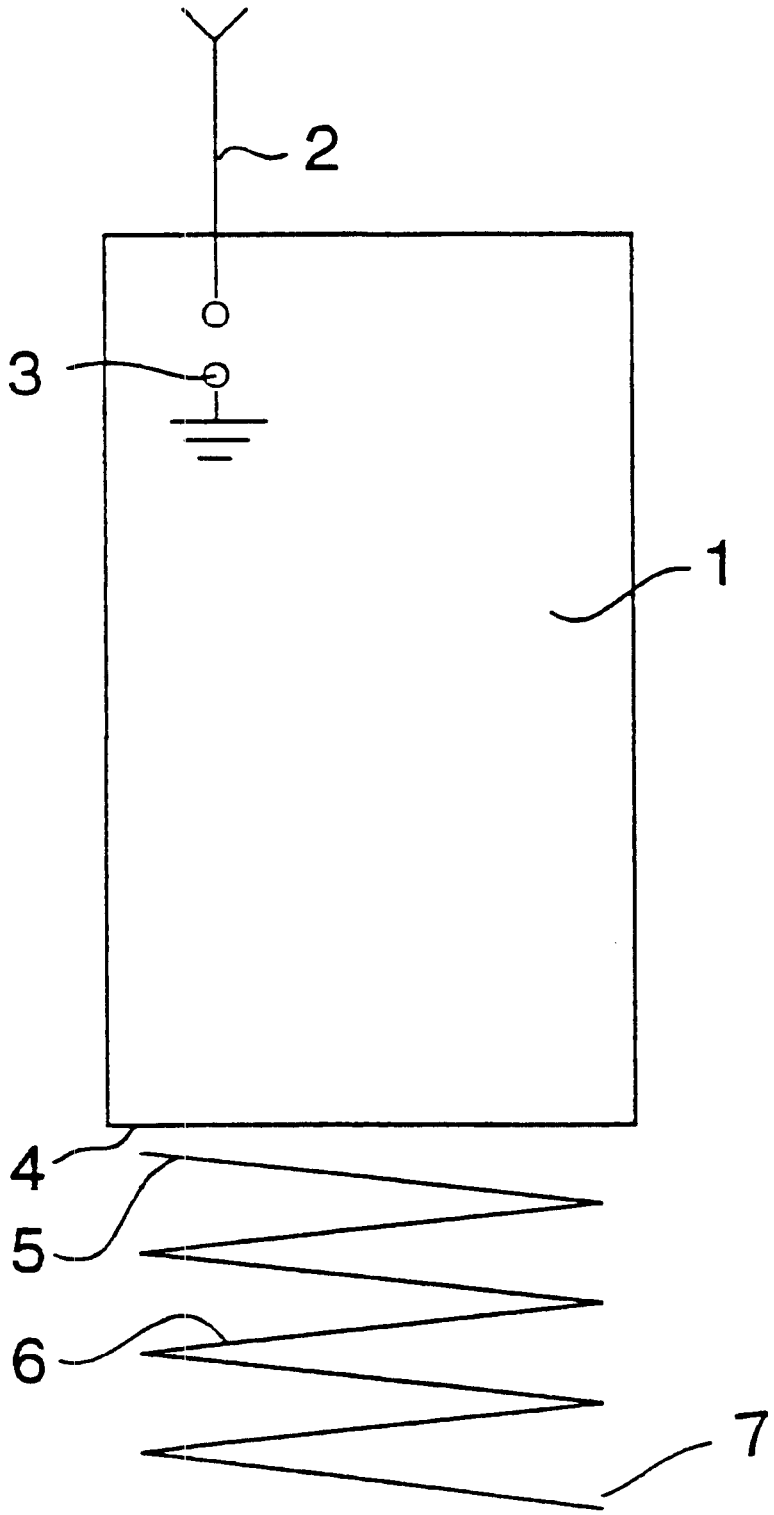
FIG. 3 shows schematically a radio communication device having ground means according to the invention including a main antenna, main ground means, and an extendable ground extension means in extended position relative to the main ground means.

FIG. 3 describes the set up of a wireless communication device, e.g. a mobile phone or a laptop. The PCB 1 is usually shielded and the shielded area is connected to one end of the feeding point of the antenna. The antenna 2 might have a matching circuit (not shown) at the feeding point 3. The standard antenna 2 might be a helix, a whip, a meander or any combination of it. At the opposite or another end of the device 4 of the feeding point 3, another antenna part 6 is coupled electromagnetically with one end 4 of the antenna part 6. The other end of antenna part 7 is further away from the shielded area 1 than the end of the antenna part 5.

Figure 4:
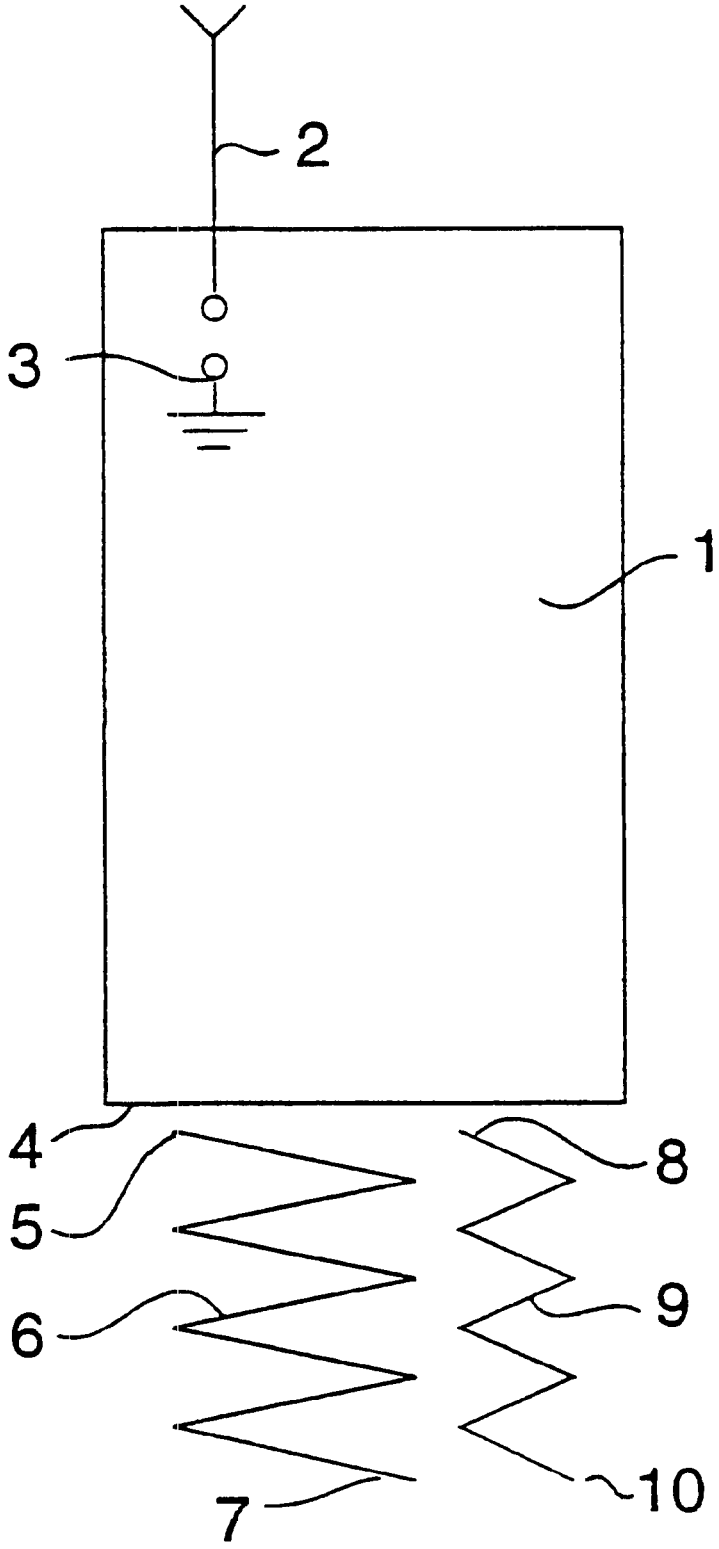
FIG. 4 shows schematically a dual band device having dual conductor ground means and being generally similar to the device of FIG. 3.

FIG. 4 describes a similar arrangement like FIG. 1 with two antenna parts for a dual band resonant application. In this embodiment one antenna part 6 is tuned to one frequency and another antenna part 9 is tuned to another frequency. Both are coupled to the shielded ground area of the device 1.

Figure 5:
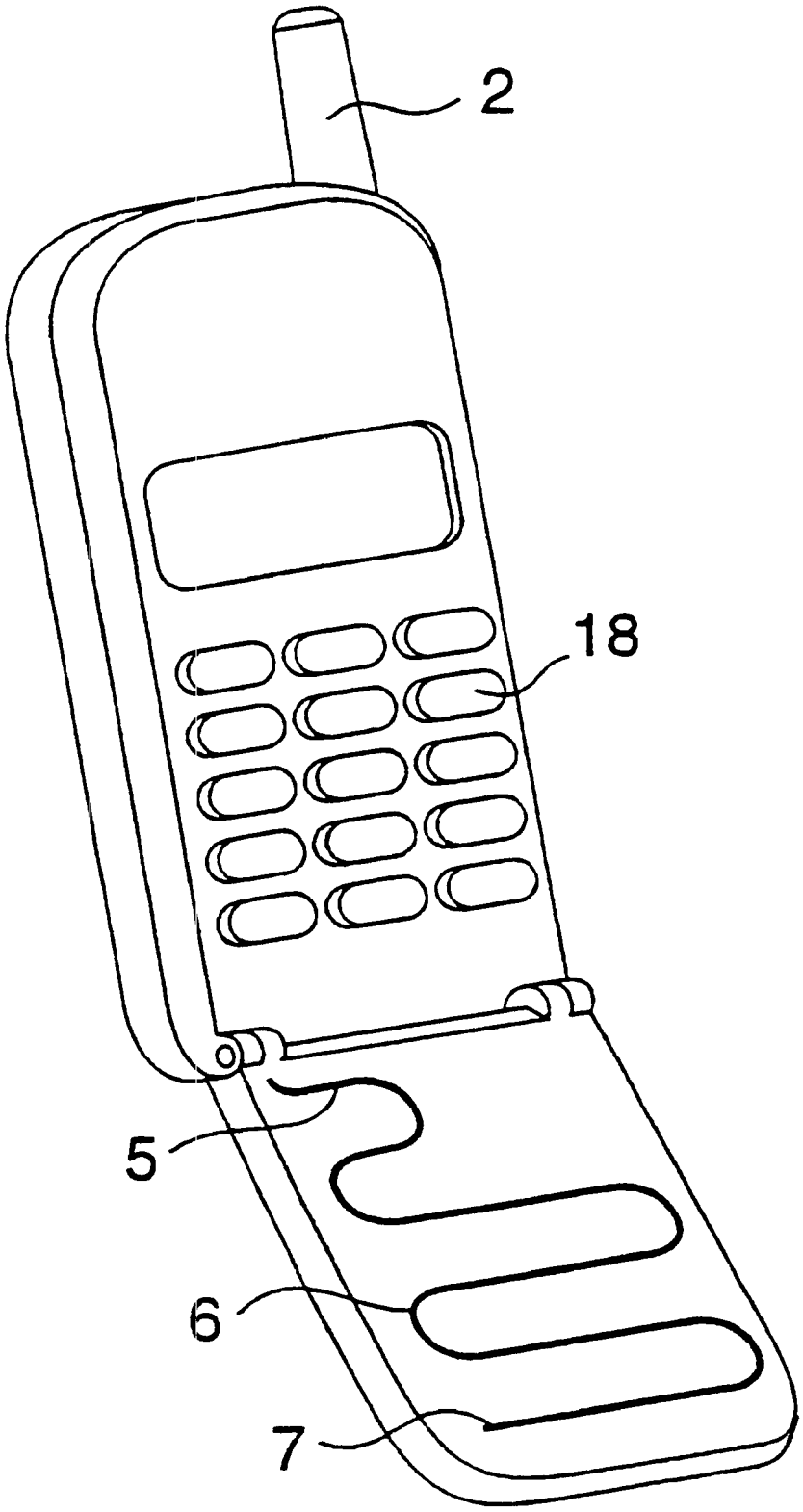
FIG. 5 shows one embodiment of a mobile telephone according to the invention wherein a main housing is provided with a an outwardly projecting antenna element at one end and an extendable ground means at the other end.

FIG. 5 describes a mobile phone with a common flap part. This flap part shields the keys mechanically when folded to the device, and it enlarges the phone in the extended position mechanically. Further more it might have a microphone function or air channels for speech transmission. Antenna part 6 is coupled without galvanic connection to the shielded area of the device 1, according to FIG. 1. Since the coupling does not need a galvanic connection, no special hinge with a contact integrated is required.

Figure 6:
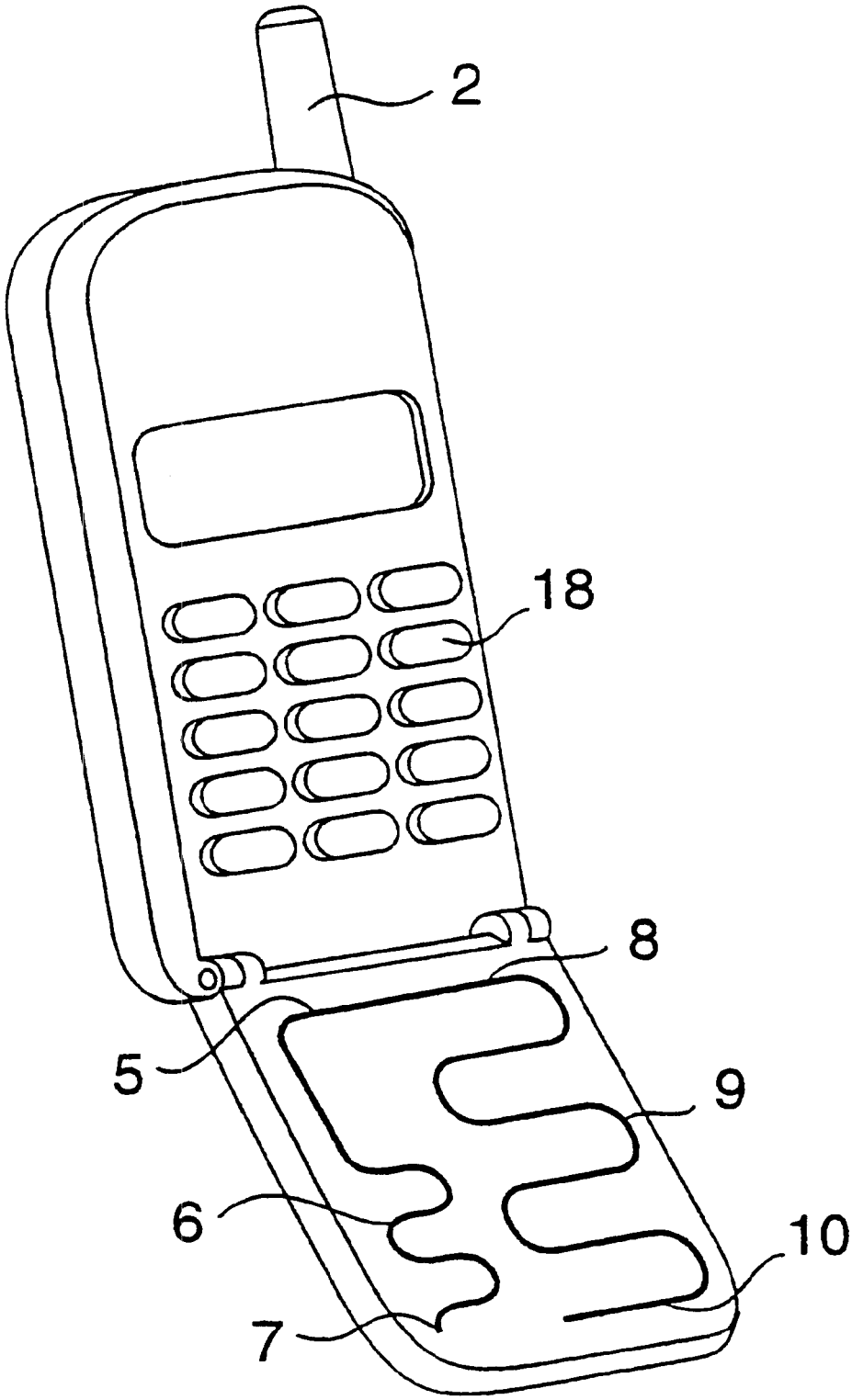
FIG. 6 shows a dual band device having dual conductor ground means in a second embodiment generally similar to that of FIG. 5.

FIG. 6 describes a dual band feeding arrangement where both meanders are connected at end 5 to end 8 galvanically (conductively).

Figure 7:
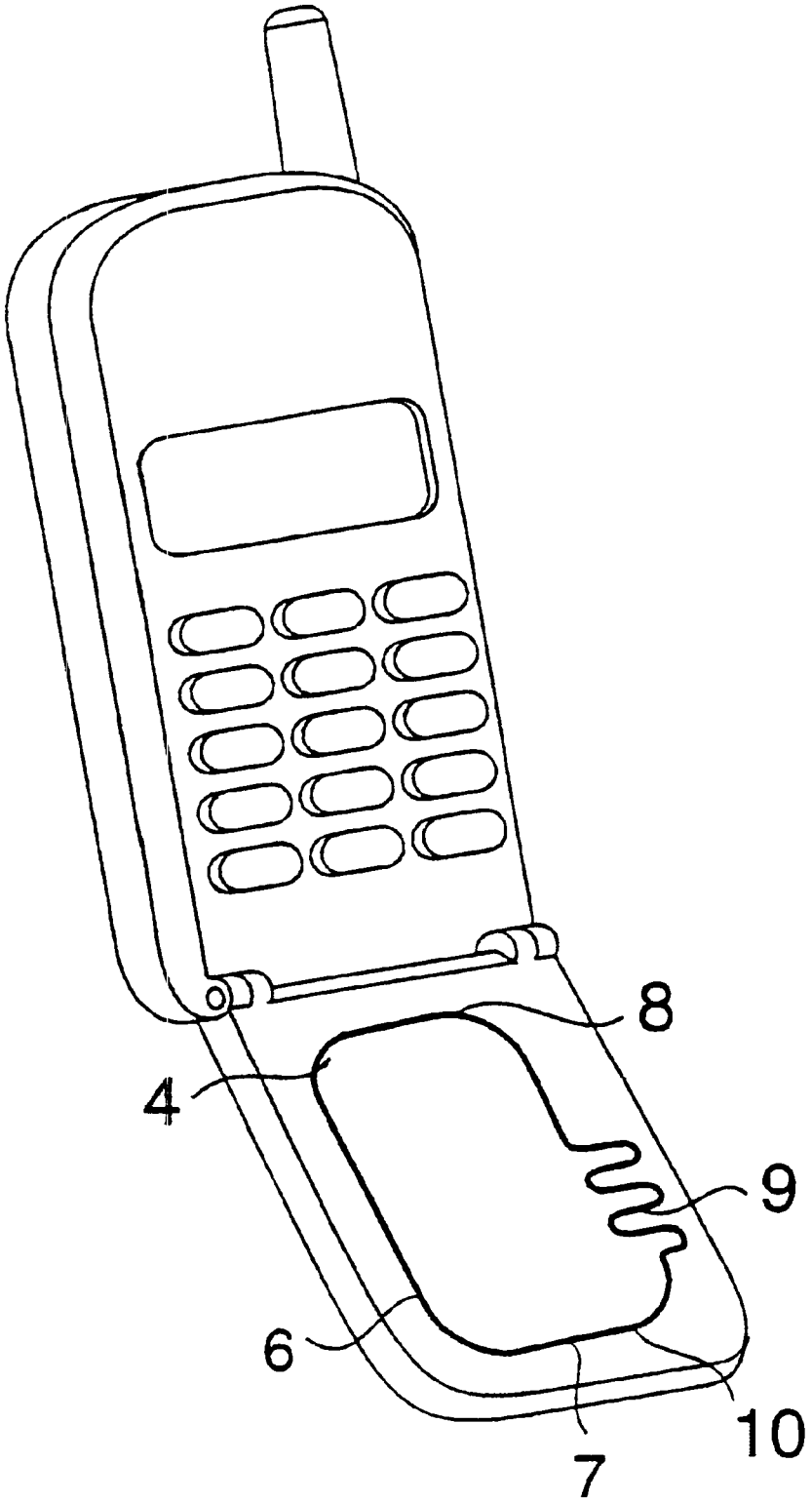
FIG. 7 shows a device having ring conductor ground means in a third embodiment generally similar to that of FIG. 5.

FIG. 7 describes a dual band feeding arrangement where both meanders are connected at their ends 5 8 and at ends 7 10. Now it becomes a ring structure.

Figure 8:
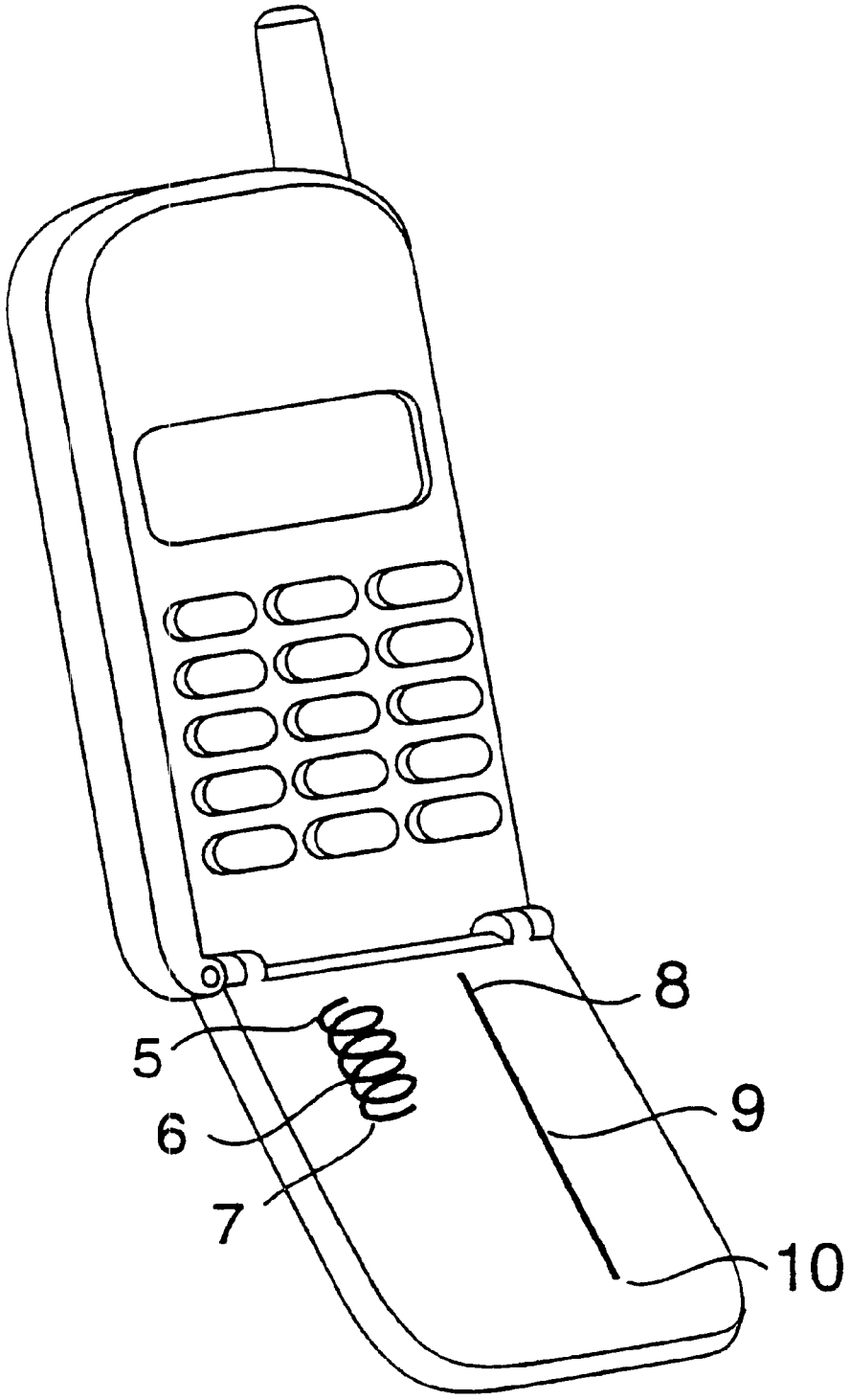
FIG. 8 shows a device having a helical and straight conductor ground means in a fourth embodiment generally similar to that of FIG. 5.

FIG. 8 describes a dual band feeding arrangement where the antenna part 6 is a helix or a whip with cylindrical shape 9.

Figure 9:
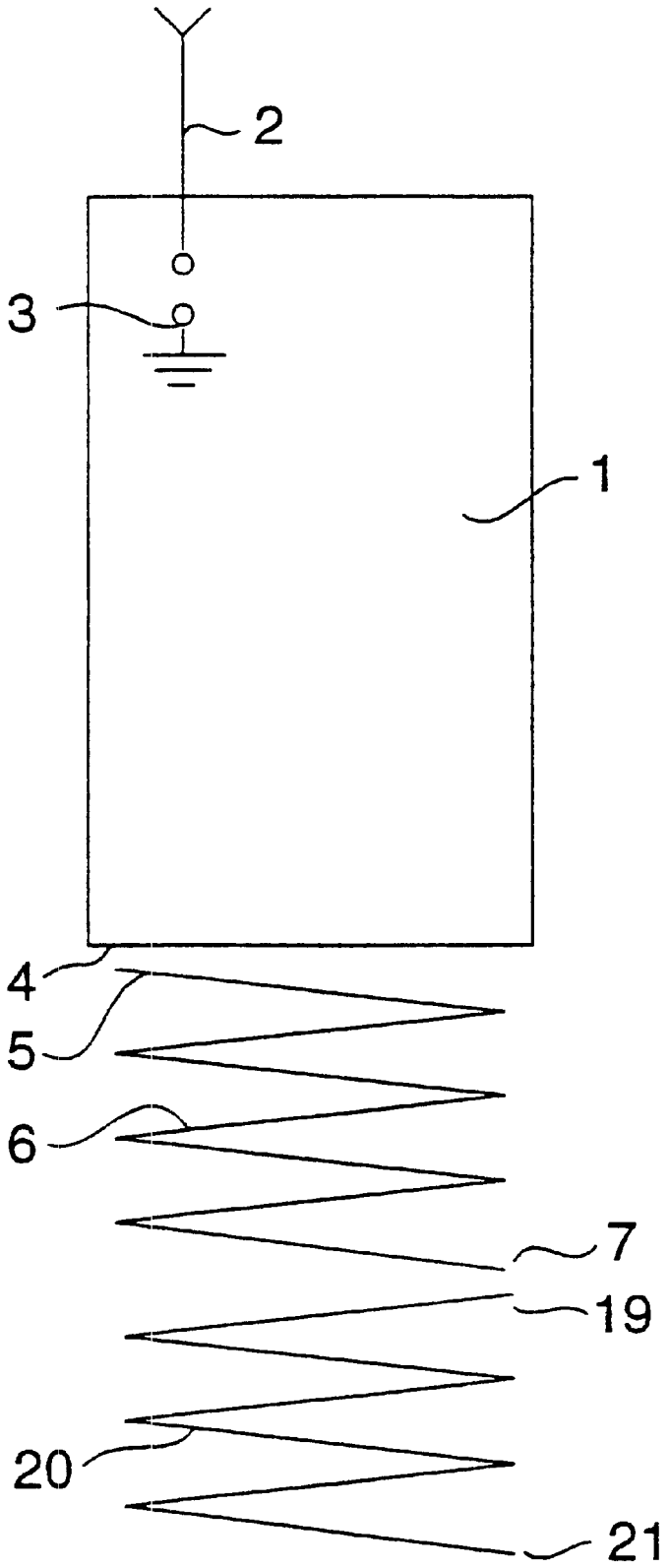
FIG. 9 shows schematically a radio communication device having ground means according to the invention including a main antenna, main ground means, and two extendable ground extension means in extended position relative to the main ground means.

FIG. 9 describes a single band application where part 6 and part 9 having similar electrical length and both are coupled electromagnetically from end 7 to 8 in a serial arrangement.

Figure 10:
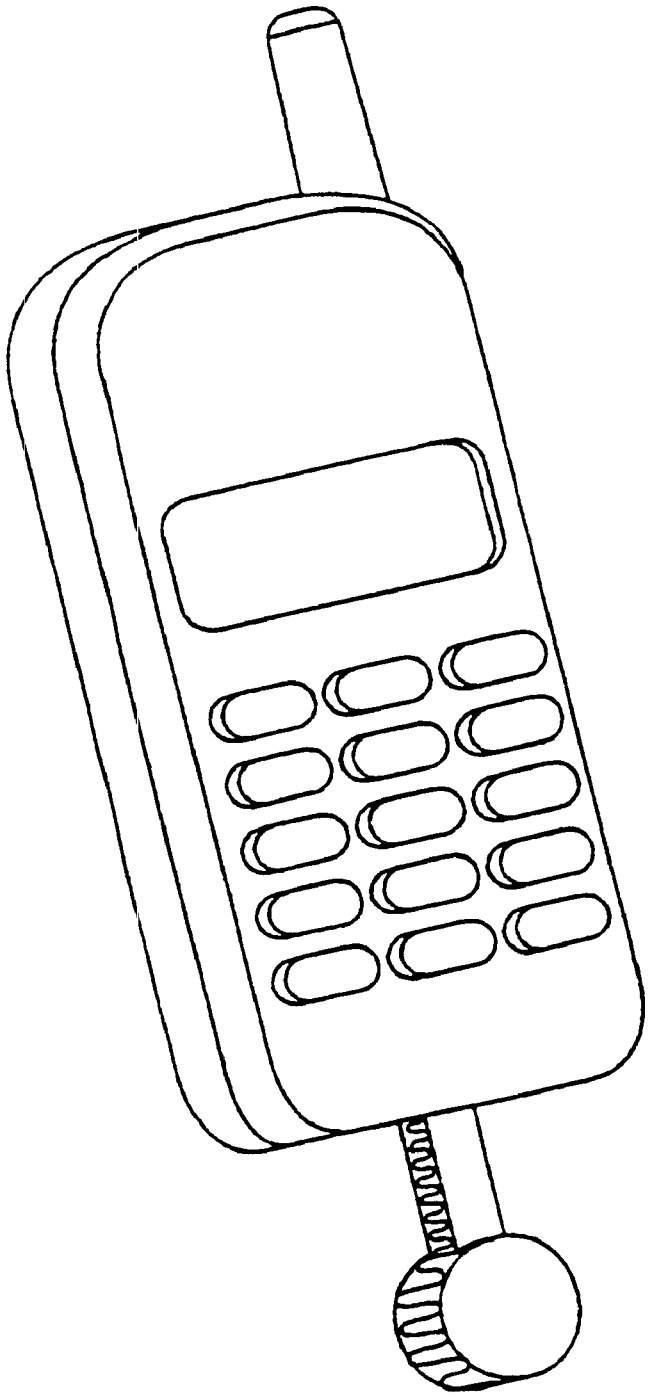
FIGS. 10 and 11 show mobile telephones having possible further variations of the extendable ground means of the invention, electrically similar but mechanically different to those of FIG. 5.
Figure 11:
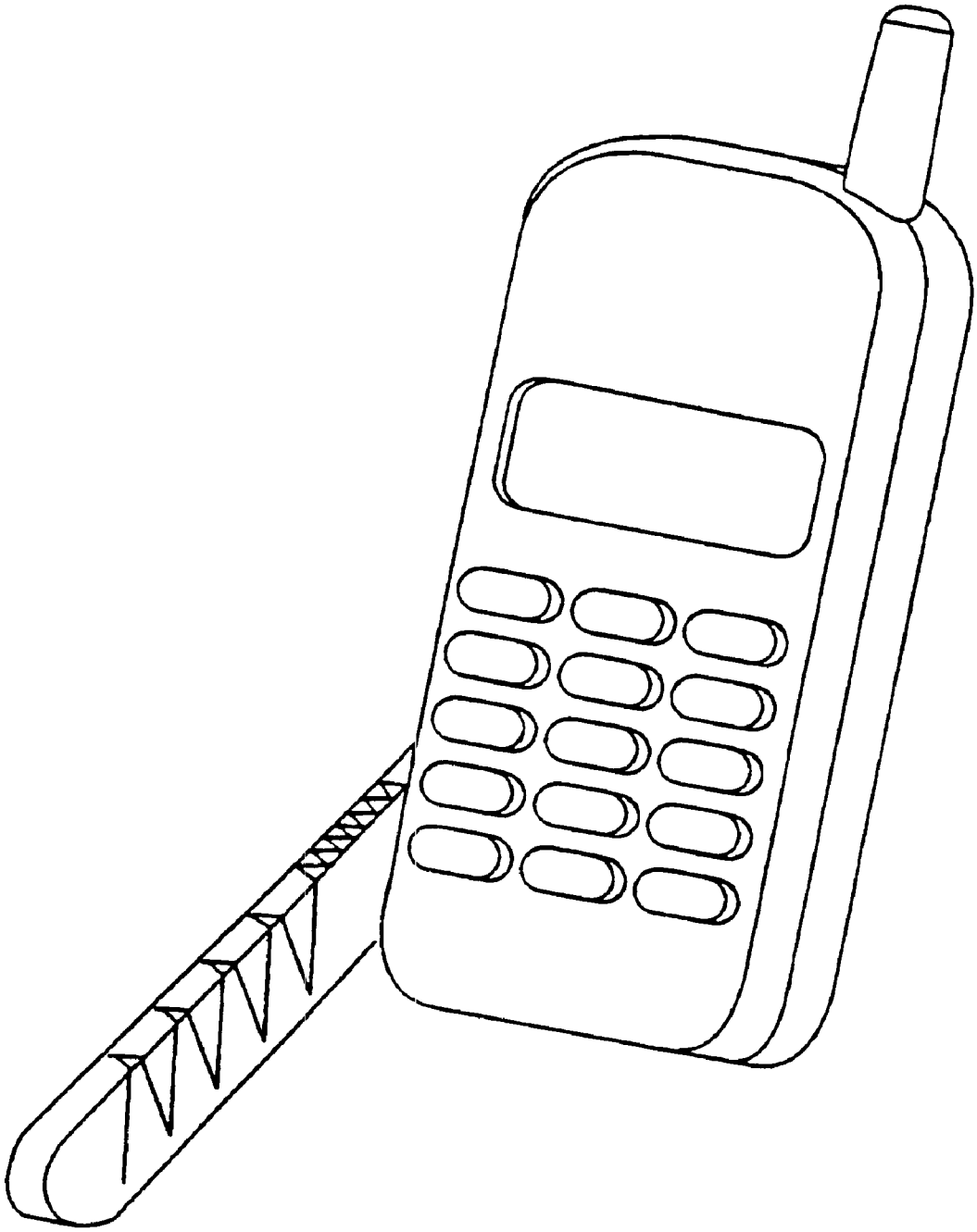

FIGS. 10 and 11 show alternative embodiments wherein the extendable portions is a narrow slide part located at one end along a longitudinal axis of a telephone and a rotatable leg at one corner of a telephone, respectively.

It should be pointed out that the above-described embodiments are examples only of how to apply the invention. Specifically, it is obvious to a skilled person to combine different features of the different embodiments to form further variations within the scope of this invention.

What is claimed is:

1. Ground extension arrangement for an antenna system in a radio communication device to be operating within at least a first frequency band, said ground extension arrangement comprising:

support means having at least first and second opposed edges or ends, conductive ground extension means supported by said support means, said support means having fastening means adapted to locate said support means such that at least said first and second edges are adjacent to and spaced from, respectively, a main ground means of a radio communication device, said ground extension means extending between said first and second edges, said ground extension means being adapted to radiate within said first frequency band, said ground extension means being adapted to couple to said main ground means to be located adjacent to said first edge.

2. Arrangement of claim 1, wherein said ground extension means is adapted to couple non-conductively to said main ground means.

3. Arrangement of claim 1, wherein said ground extension means is adapted to couple capacitively to said main ground means.

4. Arrangement of claim 1, wherein said fastening means is adapted for mechanically connecting said support means adjacent to said main ground means.

5. Arrangement of claim 1, wherein at least said second edge is substantially displacable relative to said radio communication device.

6. Arrangement of claim 1, wherein said fastening means is adapted for movably connecting said support means.

7. Arrangement of claim 1, wherein said ground extension means constitutes by itself said support means.

8. Arrangement of claim 1, wherein said support means is at least partly non-conductive.

9. Arrangement of claim 1, wherein said ground extension means includes at least one conductor including a geometry of an element selected from a group consisting of a helix, meander, rod, patch, and loop.

10. Arrangement of claim 1, wherein said ground extension means is resonant at at least one frequency.

11. Arrangement of claim 1, wherein said ground extension means is adapted to couple capacitively.

12. Arrangement of claim 1, wherein said ground extension means is adapted to couple to ground means to be located adjacent to said first edge.

13. Arrangement of claim 1, wherein said ground extension means extends partly in parallel with said first edge.

14. Arrangement of claim 1, wherein said ground extension means includes first and second conductors resonant within said first and a second frequency bands, respectively, said bands including frequencies having an approximate ratio of 1:2.

15. Arrangement of claim 1, wherein said ground extension means has an electrical length of approximately half a wavelength.

16. Arrangement of claim 1, wherein said main ground means has an electrical length of approximately one quarter of a wavelength.

17. Arrangement of claim 1, wherein said ground extension means is arranged to couple to one edge of said main ground means.

18. Antenna system for a radio communication device, comprising a main ground means, at least one hot main antenna element, and a ground extension means according to claim 1.

19. Radio communication device including an antenna system according to claim 18, comprising:

a housing having first and second opposed ends, radio transceiver circuitry having hot and ground signal connections, a main ground means coupled to said ground signal connection, an antenna element coupled, in proximity to said first end, to said hot signal connection, a ground extension means coupled to said ground signal connection, and said ground extension means being movably arranged relative to said main ground means.

20. Device of claim 19, wherein at least one of said main antenna element and said main ground means being conductively coupled to said hot and ground signal connections, respectively.

21. Device of claim 19, wherein said main ground means and said ground extension means include portions extending in parallel to provide capacitor means.

22. Device of claim 19, wherein said ground extension means and said housing include means for rotatably connecting the same.

23. Device of claim 19, wherein said ground extension means and said housing include means for slidably connecting the same.

24. Antenna system for a radio communication device, comprising:

main ground means having upper and lower opposed ends, main antenna means at said upper end, movably extendable ground extension means, in particular an arrangement according to claim 1, at said lower end, and said extendable ground means being electromagnetically coupled to said main ground means.

25. System of claim 24, wherein said main ground means and said main antenna means are interconnected by balun means.

26. System of claims 24, further including an extendable antenna means coupled to said main antenna element.

* * * * *